United States Patent [19]

Flemings et al.

[11] 4,295,896

[45] Oct. 20, 1981

[54] METHOD FOR MAKING METAL ALLOY COMPOSITIONS AND COMPOSITION

[75] Inventors: Merton C. Flemings; Frank E. Goodwin, both of Cambridge, Mass.

[73] Assignee: Massachusetts Institute of Technology, Cambridge, Mass.

[21] Appl. No.: 39,226

[22] Filed: May 14, 1979

Related U.S. Application Data

[63] Continuation-in-part of Ser. No. 20,101, Mar. 12, 1979, abandoned.

[51] Int. Cl.[3] ..... C22F 1/04

[52] U.S. Cl. ..... 148/1; 75/135; 75/138; 75/141; 148/4; 148/11.5 A; 148/12.7 A; 148/13; 148/32; 148/32.5; 148/159

[58] Field of Search ..... 148/3, 2, 11.5 A, 12.7 A, 148/13, 159, 32, 32.5, 1, 4; 75/135, 138, 141

[56] References Cited

U.S. PATENT DOCUMENTS 4,106,956 8/1978 Bercovici ..... 148/11.5 A

*Primary Examiner*—R. Dean

*Attorney, Agent, or Firm*—Arthur A. Smith, Jr.; Paul J. Cook

[57] ABSTRACT

Metal compositions having significantly improved mechanical properties and substantially free of second phase material are produced by heating a metal alloy from the non-equilibrium solidus temperature while subjecting the liquid-solid mixture to high pressure and forcing the liquid through a filter. The solid is rapidly quenched to retain solutes in solid solution or the solid is heat treated to permit solution of remaining secondary phase material followed by rapidly quenching the heat treated alloy. The solid then is re-heat treated at low temperature to permit age hardening. If the material is to be used in wrought form, it may be worked at any stage of the processing after interdendritic liquid is removed.

The process can be used to work as semi-solid metal compositions which previously have been thought unworkable, to reduce the composition differences between regions of primary phases, to remove phase and impurities known to reduce the strength of alloys, and to modify the structure of the solid phase of alloys. Metal compositions which previously have only been made with structures containing secondary phases material present have been made with substantially no secondary phase material present by this process.

34 Claims, 8 Drawing Figures

METHOD FOR MAKING METAL ALLOY COMPOSITIONS AND COMPOSITION

The Government has rights in this invention pursuant to Contract No. DAAG29-77-C-0023 awarded by the Department of the Army.

REFERENCE TO RELATED APPLICATIONS

This application is a continuation-in-part of Ser. No. 020,101, filed Mar. 12, 1979, abandoned.

BACKGROUND OF THE INVENTION

This invention relates to metal compositions having improved mechanical properties and to a method for making the metal compositions. More particularly, this invention relates to a method for making such compositions wherein a portion of the metal sample is removed as liquid during heating at elevated temperature and pressure followed by heat treating the remaining solid.

Present methods for obtaining high strength metal alloys all depend on producing a very fine distribution of the interdenritic secondary phases present in the alloy. This fine distribution is necessary so that the dissolution of the second phases into the primary phases can be accomplished in a relatively short time.

All cast alloys possess significant amounts of these secondary phases which result from "nonequilibrium" solidification. The presence of these secondary phases limits the compositions of the alloys that can be practically cast and worked, and the properties of these alloys. For example, significant increases in strength of 7000 series aluminum alloys could be achieved by increasing the alloy content above that of 7075 alloy or its newer modifications. However, when such increases are made in ingots, the amount of secondary phases increases to a point that ingot-working is difficult or impossible, ingot cracking is a problem and the secondary phases are not fully solutionized within practically obtainable cycles.

Secondary phases also result from impurities present, such as iron in 7000 series alloys and these are not in general eliminated by heat treatment in processes employed up to this time. Secondary phases are also well known to limit the mechanical properties of ferrous and superalloys, examples being the sulfides in steel and the alloy eutectic in $\gamma'$ strengthened superalloys. If these alloys could be produced with a structure exactly like that now achieved, but without precipitation of this secondary phase at the end of solidification, significant increases in room temperature and elevated temperature properties could be obtained.

There are several processes used at present to produce a fine distribution of secondary phases. Processes such as atomization (production of alloys from rapidly solidified powders and compaction), mechanical working of conventional ingots, and the use of chill molds are all employed to obtain a fine distribution of secondary phases in the metal alloys. However, these processes are difficult and expensive and often unreliable. It is thus costly at present to obtain a high alloy content metal free of second phases, limiting the commercial use of these metals to highly specialized applications.

Fractional crystallization as a means for purifying metal alloys is well known. The available purification procedures are based upon the fact they when an alloy which solidifies over a temperature range is taken to a temperature within its liquid-solid range, the solid phase has a composition different from the liquid phase. The average composition of both the liquid and solid portions of the metal alloy also depends upon the temperature of the liquid-solid mixture. By controlling the temperature of the system, the impurity to be removed, which in this case is in the form of secondary phases which are deleterious to the metal compositions, can be isolated in either the solid or liquid phase. Thereafter, the solid and liquid phases are separated by physical means and the purer fraction is recovered.

A wide variety of physical separation means have been proposed which, combined with fractional crystallization, are designed to recover pure metal alloys or metals. For example, centrifugal filtration has been proposed wherein the liquid-solid mixture is subjected to centrifugal forces up to about 2,500 g and the liquid under this force is passed through a filter comprising all or a portion of the wall of the container housing the mixture and the liquid phase to accumulate within the central portion of the container. The liquid then is recovered selectively, such as by decantation. Also, the process disclosed in U.S. Pat. No. 3,211,547 to Jarrett et al, issued Oct. 12, 1965 includes a step of forming crystals on the top surface of a liquid-solid aluminum composition allowing the crystals to settle and then compressing up to one-half of the surface area with tampers. The liquid then is recovered. Also, it has been proposed in British Pat. No. 508,925 to heat a metal alloy to form a liquid-solid mixture and then subject the mixture to a pressure of at least 500 atmospheres in order to force the liquid through a filter to leave a solid.

While these separation processes are capable of increasing the purity of metal compositions, they are undesirable in that a substantial portion of the liquid remains unseparated from the solid and the "efficiency" of the process is low, i.e., that often the separation process must be repeated a number of times to obtain the desired purification. Furthermore, when the alloy contains a small but excessive concentration of material capable of forming secondary phases, these processes provide little, if any, improvement in product purity and prevent the alloy from developing high strength.

The process provided herein overcomes these objections and provides efficient economical means of forming metal alloys having improved mechanical properties resulting from substantially complete dissolution of material forming interdendritic secondary phases into the primary phase material or its elimination by exudation out of the sample.

SUMMARY OF THE INVENTION

In accordance with this invention, metal alloy compositions having remarkable physical strength characteristics are produced by controlling the concentration and structure of secondary phase material in the alloy. In a first step, a metal alloy is heated within its liquid-solid region while being held under pressure to force the liquid being formed through a filter. The heating step causes sufficient melting to maintain open channels between the dendrite arms so that interdendritic liquid can be separated completely from the solid under moderate pressure. The resultant solid composition comprises a nondendritic structure which can be free of secondary phase material, yet be high in solute content. This composition also can have a fine grain structure. It is also within the scope of this invention to operate this step within the liquid-solid range but isothermally. While this mode of operation results in acceptable product when combined with the steps described below, its use is not preferred since far less acceptable product is obtained therewith.

In a second step, the solid composition having a low concentration of secondary phase material is heated to dissolve remaining secondary phase material into the primary phase at a temperature such that the entire composition is solid. This heated solid is then treated so that the second phase does not permanently reform upon cooling. This treatment can comprise the single step of quenching rapidly immediately after the first step or can comprise the combination of steps of cooling slowly followed by heating to redissolve any secondary phase followed by quenching rapidly. In an alternative embodiment, in a third and final step, the sample is heated to a temperature such that "age hardening" occurs. If the final material is to be used in wrought form, it may be worked before the second step, after the second step but before the third, after the third step, or at more than one of the above times.

DESCRIPTION OF SPECIFIC EMBODIMENTS

Figure 1:
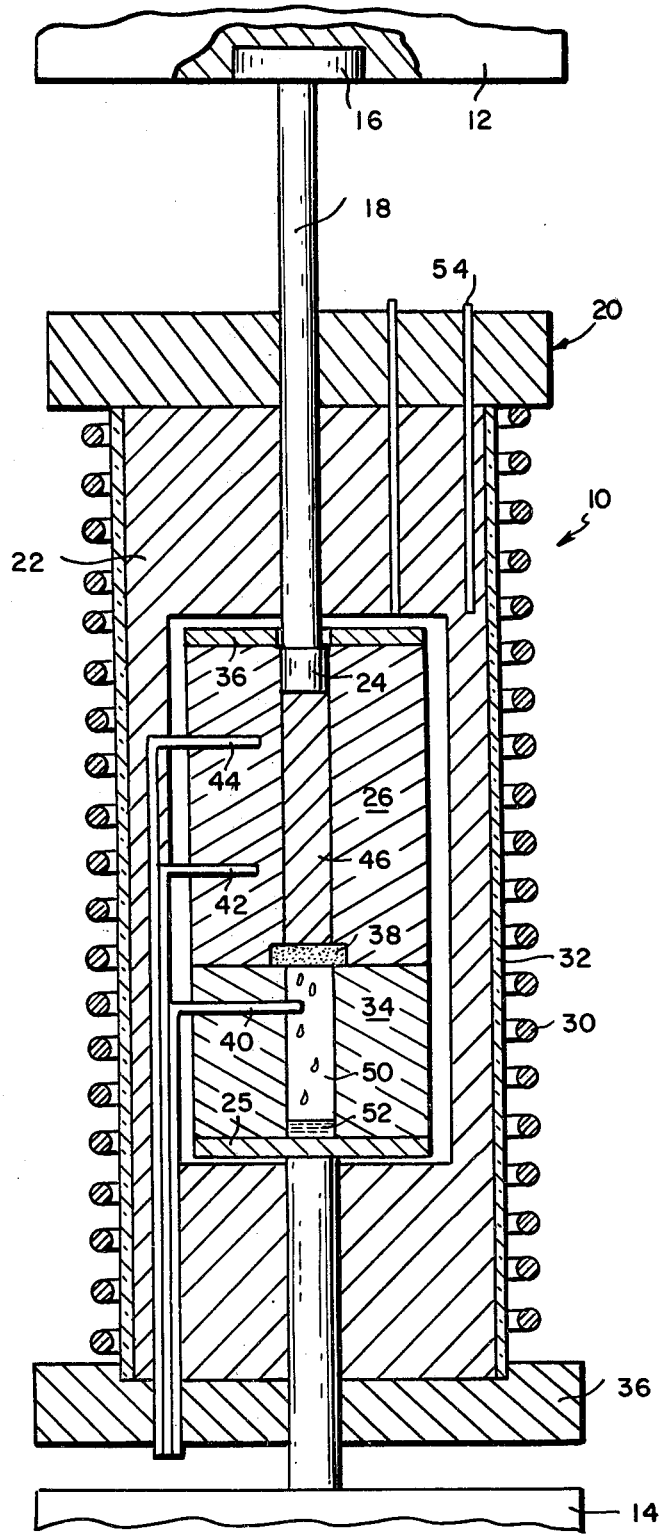
FIG. 1 is a cross-sectional side view of an apparatus used to conduct the first step of the process of this invention.

In accordance with this invention, in a first step, a metal composition is taken to a temperature at or near the non-equilibrium solidus temperature (where melting begins on heating). During heating, the composition is subjected to a superatmospheric pressure to effect separation of the solid phase from the liquid phase. It is very important to apply pressure at and above nonequilibrium solidus temperature, but it is acceptable to apply it earlier provided that it does not cause "plugging" of the filter means. The pressurized heated composition is gradually increased in temperature to a temperature causing additional liquid to form and maintaining open channels between the dendrite arms so that the interdendritic liquid can be separated completely even when utilizing moderate pressure. Alternatively, the sample can be brought to a temperature above the nonequilibrium solidus temperature so that liquid is present in the alloy and compressed out of the alloy at that temperature without further heating. However, this mode of operation is not preferred. In any case, the pressure used during the pressing operation is sufficient to overcome the inherent strength of the dendritic solid, to convert the dendrites to a fine-grain structure and is sufficient to cause the liquid to flow through and out of the solid. The pressures needed depend upon the ratio of solid to liquid, and the inherent strength of the solid dendritic structure. Generally, the pressure is greater than about 500 psi and generally between about 2000 and 10,000 psi. The phrase "separation efficiency" as used herein is defined as the percentage of liquid formed that is recovered from the solid. Separation can be effected either in a closed container wherein liquid is formed through a single hole (hourglass) of multihole filter having a pore size sufficiently small to selectively retain the solid or can be conducted between two surfaces open at the sides to force the liquid selectively out the open sides or through at least one of the surfaces which functions as a filter. After separation of liquid from solid, the solid can be removed from pressure and cooled quickly or slowly to room temperature to regulate the microstructure of the solid as desired. Alternatively, cooling can be conducted while the solid is under pressure.

The first step of the process of this invention is capable of improving the purity of an alloy which melts over a temperature range by virtue of the removal of liquid which can form secondary phase material. This step has the capacity for producing metal alloy compositions which are virtually 100% free of secondary phase material in contrast to prior art processes which are not capable of producing alloy compositions substantially free of secondary phase materials. However, in the process of this invention, it is desirable to leave components which form secondary phase in the alloy composition since such components can be dissolved within primary phases to form a solid solution having improved mechanical properties. In fact, this step is useful and valuable when it is desired to remove even a small portion of the components which form secondary phase material. For example, in certain instances such as when forming aluminum ingots by present commercial processes, it may be advantageous to remove even a small proportion of the material capable of forming secondary phases even though such ingots are better than 99% pure. In any event, the first step of this invention, when conducted with heating, is less expensive to operate as compared with presently available separation processes, is more efficient in that it permits obtaining a greater amount of purified solid and it is capable of producing an alloy substantially 100% free of secondary phase thereby permitting the operator a wide range in controlling the desired concentration of secondary phase.

In a surprising aspect of the preferred embodiment of this invention, it has been found that the yield of solid purified metal is surprisingly high. For example, the yield of purified solid in the first step of the process of this invention involving simultaneous heating and pressing can be as high as about 5 times greater than the same process when the sample is compressed isothermally.

In the second step of this invention, the metal alloy obtained from the first step and containing reduced amounts of secondary phase material is heated to a temperature for a period of time to dissolve substantially all of the remaining secondary phase material into the primary phase component of the metal alloy. Heating is controlled so that none of the alloy becomes liquid. Generally, heating is conducted at a temperature within about 50° to 10° F., preferably 20° to 10° F. of the lowest melting point of the secondary phases in order to minimize the time that heating is effected in order to dissolve the secondary phase material into the primary phase material. The particular time of heat treatment depends upon the composition of the alloy, the size of the alloy being treated, and its microstructure. Generally, heat treatment can be completed within about 3 hours and usually within about 24 hours. After heat treatment is completed, the alloy is typically quenched, such as in water, to rapidly cool the alloy and thereby preventing the formation of secondary phase material. Alternatively, the second step can be conducted by quenching the solid rapidly such as with water quench without the controlling heating. Quenching is generally complete in less than about 2 seconds, preferably less than about 1 second.

When it is desired to age harden the metal, a third treating step is utilized. In the third step, for example for aluminum alloys, the sample then is reheated to a relatively low temperature, usually between about 600° F. and 750° F. below the melting point of the solid. The temperature utilized in age hardening the alloy depends upon the composition of the alloy. Conventional age hardening temperatures for a given metal composition are well known in the art. When the secondary phase material is formed in this manner, the overall strength and hardness of the alloy is dramatically improved so that they are at least equal to and even surpass the alloy strength and hardness obtained by any presently known process such as the expensive atomization of high purity ingot metallurgy processes. If the alloy is not quenched rapidly after the second step, the secondary phase material will nucleate and grow during the slower cooling which results in reduced strength of the alloy product. Furthermore, the alloys produced by the present invention exhibit greatly improved ductility as compared to the corresponding alloys produced by the prior art processes. If it is desired to use the final metal alloy in wrought form, mechanical working of the fully solid metal alloy can be performed either before, after, or both before and after either or both of the second and third steps. Examples of mechanical working processes well-known in the art to produce wrought material are swaging, rolling, and extruding at any temperature where the alloy is fully solid. These processes effect, in the final wrought material, final reductions in area cross section ranging typically from 2/1 to 30/1.

The structure of the alloy in this final state is novel in that it contains an insignificant amount of interdendritic secondary phases while containing a relatively much higher amount of intradendritic secondary phases. It is also possible for a greater amount of alloying elements to be present than previously attainable. The higher composition enables the formation of a greater amount of intradendritic secondary phases and would ordinarily result in the formation of an excessive amount of interdendritic secondary phase. The alloy would not be useful in this state. The formation of interdendritic secondary phases is prevented in the first step of the process, enabling the alloy to be essentially entirely composed of primary phases. The heat treatment of the third step nucleates and grows the secondary phases intradendritically (age hardening), resulting in the improved properties exhibited by the alloy. The novel compositions of this invention are characterized by having a high percentage of the available solute phase dissolved in the primary phase, i.e., greater than about 90 weight percent of the available amount of solute soluble at the temperature of maximum solubility. The actual amount of solute dissolved in the primary phase will, of course, vary with the particular alloy composition being processed. In addition, the novel compositions contain very little amounts of undissolved second phase material, i.e., less than 2 volume percent based upon the entire composition and as little as 0 volume percent. In addition, since the compositions of this invention are thermally formed in a mold and have a substantial thickness of at least about ½ inch, they contain no oxide inclusions and are nonporous unlike splats or metal powder compositions made by conventional methods. Furthermore, the primary phase portions of the compositions of this invention have substantially homogeneous compositions throughout the thickness of each discrete area of primary phase.

Any metal alloy system regardless of its chemical composition can be employed in the process of this invention, except that pure metals or alloys that melt at a single temperature cannot be employed. Representative suitable alloys include magnesium alloys, zinc alloys, aluminum alloys, copper alloys, iron alloys, nickel alloys, cobalt alloys and lead alloys such as lead-tin alloys, zinc-aluminum alloys, zinc-copper alloys, magnesium-aluminum alloys, magnesium-aluminum-zinc alloys, magnesium-zinc alloys, aluminum-copper alloys, aluminum-silicon alloys, aluminum-copper-zinc-magnesium alloys, copper-tin bronzes, brass, aluminum bronzes, steels, cast irons, tool steels, stainless steels, superalloys such as nickel-iron alloys, or nearly pure metals such as iron, copper, or aluminum.

Referring to FIG. 1, an apparatus useful in the first step of this invention includes a stationery upper platform 12 and a moving lower platform 14. To the upper platform 12 is attached an electronic load sensing cell 16 which in turn supports a plunger rod 18. This plunger rod 18 passed through insulation layer 20 and graphite susceptor 22 and is positioned to contact graphite plunger 24 when in use. On the lower platform 14 is supported the induction furnace assembly, consisting of copper coil 30, quartz tube 32 and graphite susceptor 22. This furnace assembly contains an inert gas atmosphere and the graphite crucible assembly 26 consists of two steel plates 25 and 36 connected by bolts (not shown) and the upper and lower halves of the graphite crucible 34 and 26. A porous filter of material 38 such as porous alumina is contained in a recess between the two graphite crucible halves 34 and 26. Thermocouples 40, 42, and 44 are provided in the graphite crucible havles 34 and 26.

In operation, the metal alloy 46 is placed above the porous filter 38 in crucible half 26 while the volume 50 in the crucible below the filter is left vacant to accommodate collection of the liquid 52 passing through the porous filter 38. Induction coil 30 is activated in order to heat susceptor 22 so that sample 46, crucible halves 34 and 26, and plunger 24 are taken to the initial temperature where processing is accomplished as determined by thermocouples 40, 42, and 44. The furnace is controlled directly by susceptor thermocouple 54 rather than the crucible thermocouples to improve temperature stability. When the initially desired temperature is reached, pressure is generated by moving lower platform 14 upward, effecting relative movement of the graphite plunger 24 and the crucible halves 34 and 26. This pressure is kept constant while the sample is heated from the initially desired temperature to a final temperature. During this simultaneous heating and compressing, the liquid phase is formed from the low melting temperature secondary phases and passes through the porous filter 38 into the collection volume 50 beneath it. After the final temperature is reached, the metal alloy remaining above the filter is held for a time, typically twenty minutes, at this final temperature to insure that the lowest possible amount of liquid remains in the alloy. The alloy is then either rapidly quenched or slowly cooled and subjected to a second step in which the metal alloy remaining above the filter 38 is heat treated at a temperature such that the remaining secondary phases are dissolved into the primary phases, which comprises most of the remaining metal alloy. After this treatment, the metal alloy is quenched in order to retain the wholly primary phase structure. In the third step, when used, the quenched metal alloy from either of the two second steps above is heat treated at a relatively low temperature such that age hardening occurs. The resultant structure is free of intergranular secondary phases and consists of grains of primary phases with finely dispersed volumes of secondary phases throughout those grains. The shape of the mold for the metal 46 need not be cylindrical as shown, but can be of any desired shape conforming to the shape of the desired final article.

Figure 2:
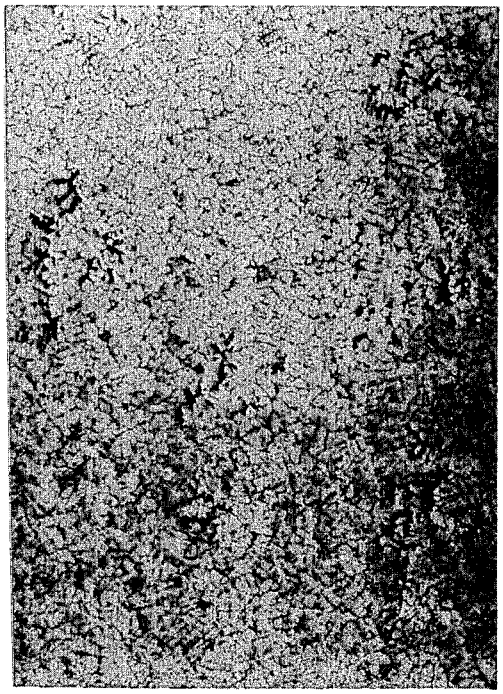
FIG. 2 is a photomicrograph of a cast Al-Mg-Cu-Zn-Cr alloy (7075) not processed by this invention at 40×.
Figure 3:
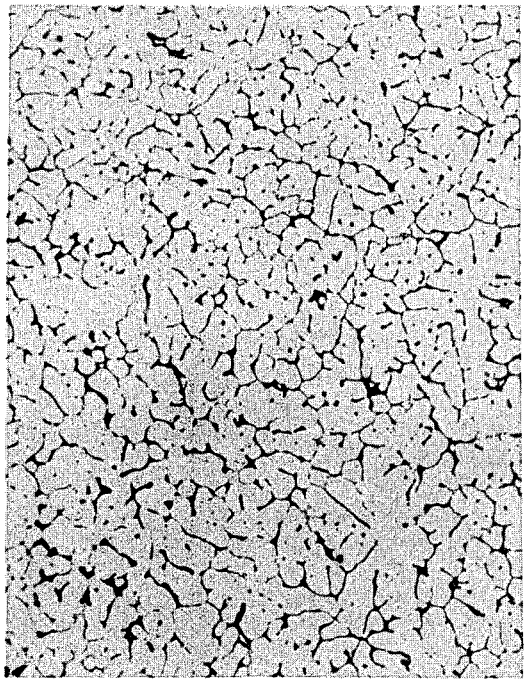
FIG. 3 is a photomicrograph of the same alloy as shown in FIG. 2 at 100×.

Referring to FIGS. 2 and 3, the initial cast structure of a 7075-type aluminum alloy is shown. This alloy differs from normal 7075 alloy in that it contains more of some alloying elements, i.e., 7075 aluminum alloy contains Zn, 5.6%, Mg 2.5%, Ca 1.6% and Cr 0.23% while this aluminum alloy contains Zn, 7.7%, Mg 3.3%, Cu 2.2% and Cr 0.23%. The light-colored dendrites are referred to as primary phases while the darker areas surrounding these primary phases are known to form later in solidification, i.e., at a lower freezing or melting point and are referred to as secondary phases. These secondary phases are known to be the volumes in which mechanical failure of the metal occurs and are hence desirable.

Figure 4:
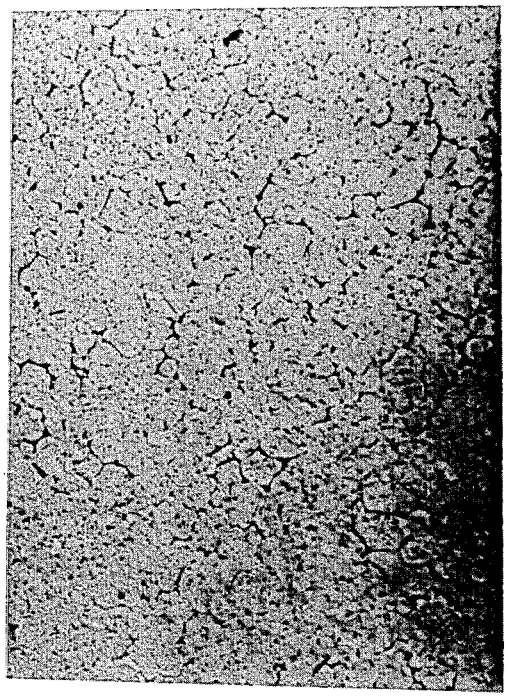
FIG. 4 is a photomicrograph of the alloy of FIG. 2 after the first step of this invention with non-isothermal heating wherein the alloy is cooled slowly within the compression apparatus of FIG. 1 at 40×.
Figure 5:
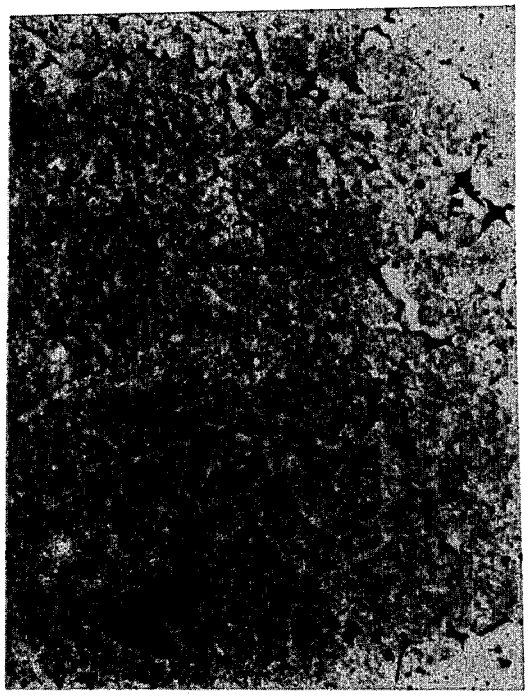
FIG. 5 is a photomicrograph of the same alloy as shown in FIG. 4 at 100×.

Referring to FIGS. 4 and 5, the structure of the casting shown in FIGS. 2 and 3 is shown after it has been subjected to the first step of this invention. The slow cooling leads to the formation of the dark secondary phases while the primary phases are rounder in shape and for the most part larger than the primary phases referred to in FIGS. 2 and 3.

Figure 6:
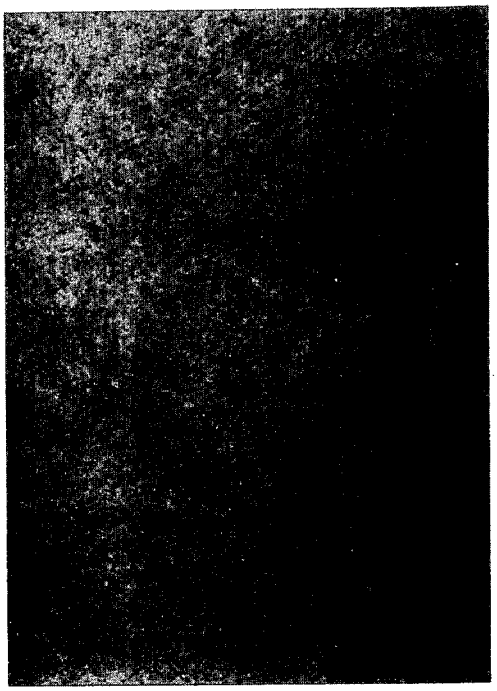
FIG. 6 is a photomicrograph of the alloy of FIG. 4 after mechanical working and heat treating at 40× of this invention.
Figure 7:
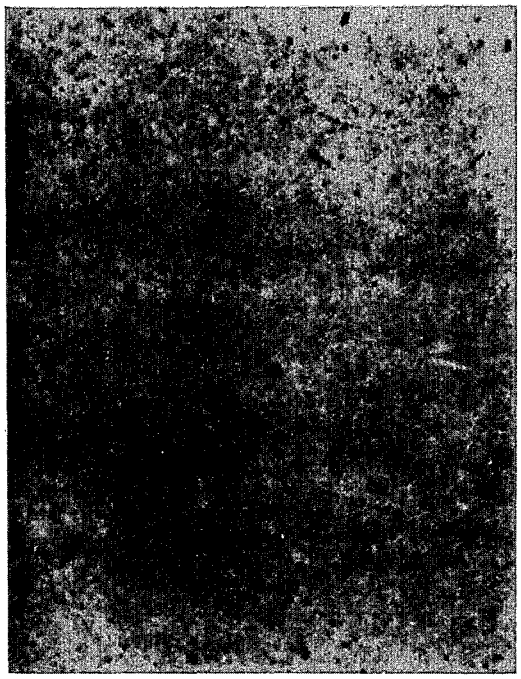
FIG. 7 is a photomicrograph of the same alloy as shown in FIG. 6 at 100×.

Referring to FIGS. 6 and 7, the structure of the sample shown in FIGS. 4 and 5 is shown after being subjected to the second step of this invention and after working as described in Example I. A complete absence of secondary phase is noted, while the grains of primary phase have grown as a consequence of the heat treatment.

The evolution of the structure of a particular metal alloy composition is thus shown by FIGS. 2 through 7. A change in chemical composition and microstructure is effected by the first process step, while the second and third step effect microstructural changes.

Figure 8:
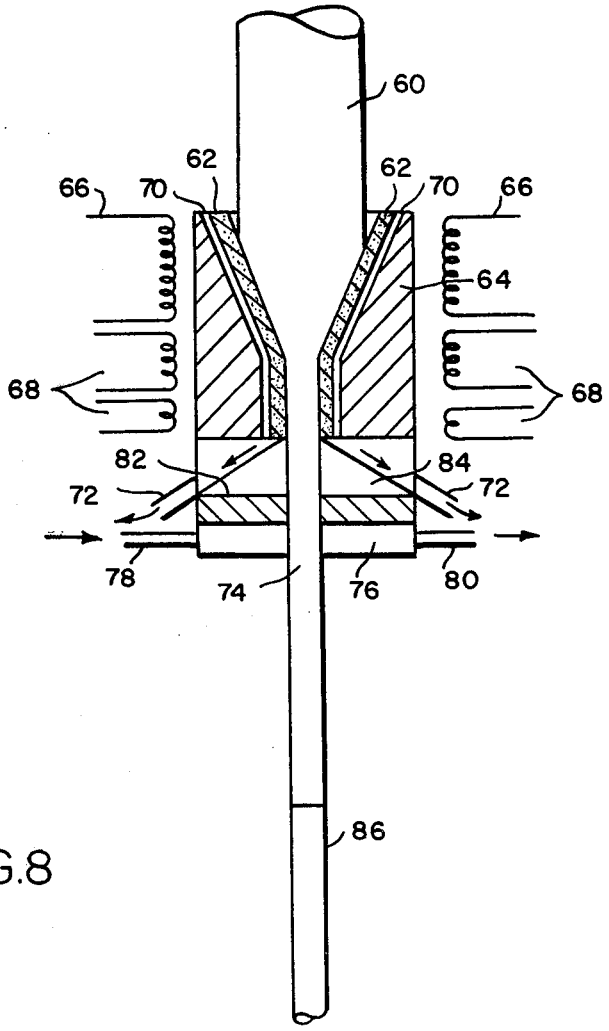
FIG. 8 is a cross-sectional side view of an apparatus used to conduct the first step of the process of this invention continuously.

Referring to FIG. 8, a feed bar 60 formed of a metal alloy is directed under pressure into contact with a porous inclined conical plate 62. The plate 62 is supported on a thermally conducting base 64. Heaters 66 are positioned near the top of the porous plate 62 in order to heat the metal to its nonequilibrium solidus temperature and heaters 68 are positioned near the bottom of plate 62 to heat the metal alloy to the desired final temperature. The liquid formed is forced through plate 62 and is allowed to rush down a gap 70 between plate 62 and base 64 and is removed through parts 72. The refined solid 74 is passed through cooling disk 76 through which a cooling liquid such as water is passed in order to fully cool the bar and minimize undesirable creep. Cooling liquid enters disk 76 through conduit 78 and is removed through conduit 80. An insulation disk 82 is positioned between cooling disk 80 and base 84. Dummy bar 86 can be used in a conventional manner to initiate passage of the feed bar through the apparatus.

The following example illustrates the present invention and is not intended to limit the same.

EXAMPLE I

This example was conducted with cast Al-7.7% Zn-3.3% Mg-2.2% Cu-0.23% Cr alloy (7075 alloy with 35% more of each alloying element except Cr which was held constant) having the structure shown in FIG. 2. The experiment was performed with the apparatus shown in FIG. 1. As set forth above, the apparatus consisted of a temperature controlled furnace, a graphite crucible for holding the metal alloy, the filter, and a plunger to compress the metal alloy against the filter.

The furnace had a hollow cylindrical geometry, a power of 12.5 kilowatts, and had a temperature capability of at least 660° C. The graphite crucible assembly, 4.5 inches high, 3.25 inches outer diameter and 0.625 inches inner diameter, was placed inside the furnace assembly. A cylindrical sample of the metal alloy, 0.623 inches in diameter and 3.25 inches long, was placed inside the crucible assembly.

Temperature was spatially uniform within the sample to within 1° C. throughout the heating and pressurization portion of the first step of the invention. Thermal gradients were eliminated by flowing argon in the volume between the furnace assembly and the crucible assembly. Three chromel-alumel thermocouples were embedded in the crucible assembly along its length. A thermocouple was also placed so as to contact the graphite plunger from the plunger rod side. The experiment was begun only when all the thermocouples were reading within 1° C. of each other.

The alumina filter used in this experiment was fit into a closely machined recess between the two halves of the graphite crucible. It was ¼" thick and had a pore size of 200 microns. The plunger was supported by the plunger rod and moved relative to the crucible assembly by moving the crucible and furnace assembly upward on the moving platform. This moving platform was the crosshead on an Instron mechanical testing machine. The load measured by the Instron load cell was recorded on a chart for the duration of the test. The position of the crosshead during the test was recorded manually.

After the initial processing temperature of 490° C. was reached, the graphite plunger was driven into the sample in such a way that a constant pressure of 3000 psi was maintained during subsequent heating. The heatup rate at this pressure was 2° C. per minute until the final temperature of 565° C. was reached. The apparatus was stabilized at this temperature and the 3000 psi pressure maintained for 20 minutes. At this point, power to the furnace was shut off and the apparatus allowed to cool to room temperature. Samples were taken for chemical analysis and metallography from the metal alloy remaining above the filter.

Following this step one, the material was hot-swaged at approximately 800° F., reducing its cross-sectional area about 4 to 1. The metal specimen, i.e., the portion of the metal alloy remaining above the filter, which coming from the apparatus had the dimensions of 0.675 inches diameter and 3 inches long, was swaged to a final size of 0.35 inches diameter and 7 inches long. The swaged alloy was then machined into samples for mechanical testing. Samples were 0.25 inches reduced section diameter and 1 inch gauge length.

In the second step of this invention the samples machined for mechanical testing were placed in a forced convection furnace at 490° C. for 24 hours. Maximum temperature variation during this time was 5° C. Upon removal from the furnace, the sample was quickly quenched in a large tank of cold water. A sample was taken from one of the samples for metallography.

In the third step of this invention, the same samples were placed in the same furnace for 24 hours at 120° C. Maximum temperature variation during this time was 2° C. Upon removal from the furnace, the samples were quickly quenched in brine. A sample was taken from one of the same for metallography. The microstructure of the sample at this point is shown in FIG. 4. Specimens were then tested at constant strain rate on a mechanical testing machine. The results of these tests are given below.

| Bar | Brinell Hardness | Yield Stress | Ultimate Tensile Stress | Ductility | Reduction In Area |
|---|---|---|---|---|---|
| A | 157 | 75,164 | 88,710 | 11 | 14 |
| B | 148 | 71,789 | 87,900 | 13 | 17 |
| C | 133 | 79,670 | 94,465 | 7 | 12 |

For comparison, a sample cast at the same time as the sample above was tested after only the heat treating steps. The results of this test are given below.

| Bar | Yield Stress (= ultimate tensile stress here) | Ductility |
|---|---|---|
| A | 43,480 | 2 |
| B | 58,226 | 1 |
| C | 52,174 | 2 |

As shown from these results, the composition of the invention provides substantially better mechanical properties.

We claim:

1. The process for forming a metal alloy composition free of oxide inclusions, free of porosity and containing solutes derived from said alloy composition in an amount greater than 90 weight percent of the amount soluble at the temperature of maximum solubility and containing less than 2 volume percent of undissolved second phase which comprises heating a first alloy from the nonequilibrium solidus temperature to form a solid-liquid composition, subjecting said solid-liquid composition to pressure for a time sufficient to overcome the inherent strength of the solid, to convert dendrites in the solid to a fine grain structure, to homogenize and compact the composition of the dendrites, and to cause the liquid to flow through and out of said solid and preventing the formation of secondary phase material either by rapidly quenching said solid or by cooling said solid followed by heat treating said cooled solid at a temperature less than that at which liquid metal from said alloy forms for a period of time to dissolve substantially all said secondary phase into said primary phase and rapidly quenching said heat treated solid to form a cooled solid.

2. The process of claim 1 wherein the first alloy is heated from its nonequilibrium solidus temperature to form a solid-liquid composition while confining said first alloy under said pressure.

3. The process of claim 1 wherein the formation of said secondary phase material is prevented by rapidly quenching said heated solid.

4. The process of claim 2 wherein the formation of said secondary phase material is prevented by rapidly quenching said heated solid.

5. The process of claim 1 wherein the formation of said secondary phase material is prevented by cooling said solid followed by heat treating and rapidly quenching said solid to form a cooled solid.

6. The process of claim 2 wherein the formation of said secondary phase material is prevented by cooling said solid followed by heating treating and rapidly quenching said solid to form a cooled solid.

7. The process of any of claims 1 through 6 wherein the cooled solid is reheated to a relatively low temperature for a time sufficient to permit age hardening.

8. The process of any of claims 1 through 6 wherein said pressure is above about 500 psi.

9. The process of claim 7 wherein said pressure is above about 500 psi.

10. The process of any of claims 1 through 6 wherein the liquid and solid are housed in a container and the liquid is forced under said pressure through a filter to pass said liquid through said filter and to retain said solid in said container.

11. The process of claim 7 wherein the liquid and solid are housed in a container and the liquid is forced under said pressure through a filter to pass said liquid through said filter and to retain said solid in said container.

12. The process of claim 8 wherein the liquid and solid are housed in a container and the liquid is forced under said pressure through a filter to pass said liquid through said filter and to retain said solid in said container.

13. The process of claim 9 wherein the liquid and solid are housed in a container and the liquid is forced under said pressure through a filter to pass said liquid through said filter and to retain said solid in said container.

14. The process of any of claims 1 through 6 wherein said composition is passed under said pressure continuously through a zone wherein said composition is subjected to said pressure and is heated from its nonequilibrium solidus temperature to form said liquid and continuously removing said liquid and said solid, each separate from the other, continuously from said zone under pressure.

15. The process of claim 7 wherein said composition is passed under said pressure continuously through a zone wherein said composition is subjected to said pressure and is heated from its nonequilibrium solidus temperature to form said liquid and continuously removing said liquid and said solid, each separate from the other, continuously from said zone under pressure.

16. The process of claim 8 wherein said composition is passed under said pressure continuously through a zone wherein said composition is subjected to said pressure and is heated from its nonequilibrium solidus temperature to form said liquid and continuously removing said liquid and said solid, each separate from the other, continuously from said zone under pressure.

17. The process of claim 9 wherein said composition is passed under said pressure continuously through a zone wherein said composition is subjected to said pressure and is heated from its nonequilibrium solidus temperature to form said liquid and continuously removing said liquid and said solid, each separate from the other, continuously from said zone under pressure.

18. The process of claim 1 wherein the solid having a fine grain structure and being substantially free of liquid is worked prior to the step of dissolving secondary phase material.

19. The process of claim 1 wherein the cooled solid is worked subsequent to the step of dissolving secondary phase material.

20. The process of claim 1 which includes the steps of working the solid having a fine grain structure and being substantially free of liquid and working the cooled solid subsequent to the step of dissolving secondary phase material.

21. The process of claim 18 wherein said alloy is an aluminum alloy.

22. The process of claim 19 wherein said alloy is an aluminum alloy.

23. A cast metal alloy composition free of oxide inclusions, free of porosity and containing solutes derived from said alloy composition in an amount greater than about 90 weight percent of the amount soluble at the temperature of maximum solubility and containing less than about 2 volume percent of undissolved secondary phase, said cast metal alloy composition being formed by the process of any one of claims 1, 2, 3, 4, 5, 6, 18, 19, 20, 21 and 22.

24. A cast metal alloy composition free of oxide inclusions, free of porosity and containing solutes derived from said alloy composition in an amount greater than about 90 weight percent of the amount soluble at the temperature of maximum solubility and containing less than about 2 volume percent of undissolved secondary phase, said cast alloy composition being formed by the process of any one of claims 1 through 6 wherein the cooled solid is reheated to a relatively low temperature for a time sufficient to permit age hardening.

25. A cast metal alloy composition free of oxide inclusions, free of porosity and containing solutes derived from said alloy composition in an amount greater than about 90 weight percent of the amount soluble at the temperature of maximum solubility and containing less than about 2 volume percent of undissolved secondary phase, said cast metal alloy composition being prepared by the process of any one of claims 1 through 6 wherein said pressure is above about 500 psi.

26. The composition of claim 24 wherein said pressure is above about 500 psi.

27. A cast metal alloy composition free of oxide inclusions, free of porosity and containing solutes derived from said alloy composition in an amount greater than about 90 weight percent of the amount soluble at the temperature of maximum solubility and containing less than about 2 volume percent of undissolved secondary phase, said cast alloy composition being prepared by the process of any one of claims 1 through 6 wherein the liquid and solid are housed in a container and the liquid is forced under said pressure through a filter to pass said liquid through said filter and to retain said solid in said container.

28. The composition of claim 24 wherein the liquid and solid are housed in a container and the liquid is forced under said pressure through a filter to pass said liquid through said filter and to retain said solid in said container.

29. The composition of claim 25 wherein the liquid and solid are housed in a container and the liquid is forced under said pressure through a filter to pass said liquid through said filter and to retain said solid in said container.

30. The composition of claim 26 wherein the liquid and solid are housed in a container and the liquid is forced under said pressure through a filter to pass said liquid through said filter and to retain said solid in said container.

31. A cast metal alloy composition free of oxide inclusions, free of porosity and containing solutes derived from said alloy composition in an amount greater than about 90 weight percent of the amount soluble at the temperature of maximum solubility and containing less than about 2 volume percent of undissolved secondary phase, said cast alloy composition being prepared by the process of any one of claims 1 through 6 wherein said first alloy is passed under said pressure continuously through a zone wherein said first alloy is subjected to said pressure and is heated from its nonequilibrium solidus temperature to form said liquid and continuously removing said liquid and said solid, each separate from each other, continuously from said zone under pressure.

32. The composition of claim 24 wherein said first alloy composition is passed under said pressure continuously through a zone wherein said first alloy composition is subjected to said pressure and is heated from its nonequilibrium solidus temperature to form said liquid and continuously removing said liquid and said solid, each separate from each other, continuously from said zone under pressure.

33. The composition of claim 25 wherein said first alloy composition is passed under said pressure continuously through a zone wherein said first alloy composition is subjected to said pressure and is heated from its nonequilibrium solidus temperature to form said liquid and continuously removing said liquid and said solid, each separate from each other, continuously from said zone under pressure.

34. The composition of claim 26 wherein said first alloy conposition is passed under said pressure continuously through a zone wherein said first alloy composition is subjected to said pressure and is heated from its nonequilibrium solidus temperature to form said liquid and continuously removing said liquid and said solid, each separate from each other, continuously from said zone under pressure.

* * * * *